US005970529A

United States Patent [19]

Veal

[11] Patent Number: 5,970,529

[45] Date of Patent: Oct. 26, 1999

[54] BEDSIDE COMMODE APPARATUS

[76] Inventor: Bryant Veal, 410 Todd St., Park Forest, Ill. 60466

[21] Appl. No.: 08/530,811

[22] Filed: Sep. 20, 1995

[51] Int. Cl.[6] ..... A61G 9/00

[52] U.S. Cl. ..... 4/450; 5/604

[58] Field of Search ..... 4/450–456; 5/604

[56] References Cited

U.S. PATENT DOCUMENTS

| | | |
|---|---|---|
| 2,604,634 | 7/1952 | Eckart et al. . |
| 2,632,185 | 3/1953 | Eckart et al. . |
| 2,932,831 | 4/1960 | Keathley, Sr. et al. . |
| 3,666,131 | 5/1972 | Thompson . |
| 3,990,119 | 11/1976 | Barrett . |
| 4,233,691 | 11/1980 | Jirard . |
| 4,334,330 | 6/1982 | Marshall . |
| 4,989,280 | 2/1991 | Bair . |
| 5,363,514 | 11/1994 | Lee . |

FOREIGN PATENT DOCUMENTS

| | | | |
|---|---|---|---|
| 8003789 | 6/1988 | WIPO | 5/604 |

*Primary Examiner*—Charles E. Phillips
*Attorney, Agent, or Firm*—Sonnenschein Nath & Rosenthal

[57] ABSTRACT

A bedside commode apparatus which is removably attachable to a bed of a patient includes a base portion and a framework structure having at least one vertical support member fixedly attached to the base portion and extending upward therefrom. The framework structure includes at least one extension arm attached to an upper portion of the at least one vertical support member and extends horizontally outward toward the bed, where the at least one extension arm is configured to extend over a top surface of the bed. Also included is a bedpan to receive human waste and a bedpan support platform to releasably secure the bedpan, where the bedpan support platform is movably attached to the framework structure and is configured to move along the at least one vertical support member from a non-use position disposed toward the base portion, to a patient-use position disposed toward an end portion of the at least one extension arm. A drive motor is selectively energized by the patient to reciprocally displace the bedpan support platform and the bedpan along the at least one vertical support member and along the at least one extension arm between the non-use position and the patient-use position.

19 Claims, 5 Drawing Sheets

38
76
18
70
186
40
74
18
30
58
32
20
90
92
16
14
186
182
252
72
94
184
50
12
10
54
97
234
56
52
250

76
38
32
30
40
20
18
14
58
16
90
72
70
182
252
184
94
10
50
234
95
12
97
54
56
52
230

BEDSIDE COMMODE APPARATUS

BACKGROUND OF THE INVENTION

The present invention relates generally to invalid toilets and more specifically to an improved bedpan structure and bedpan carrier for mechanically positioning a bedpan relative to a bed of a patient.

Patients are frequently required to remain in a hospital or in a patient-care environment for extended periods of time and are often not provided with adequate facilities for excretory functions. The devices utilized by many hospitals and patient-care facilities, such as bedpans, require close attention by medical or custodial personnel in order to place the bedpan for the patient's use and to remove the pan and waste material in a timely manner after use. Shortage among such staff personnel is common and thus, close attention to patient needs is not always timely resulting in less than adequate patient comfort levels.

Invalid toilets are previously known and in their simplest form, are individual bedpans which are placed under the patient and subsequently removed and disinfected after use. Use of such devices is labor intensive, as the patient is typically bed-ridden and requires another person to deliver and remove the bedpan before and after use, respectively. Additionally, if removal after use is not immediate, the result is highly objectionable at best.

Other invalid toilets exist that have been incorporated into hospital bed structures. Such devices are complex and expensive and often cannot be used with existing hospital beds. Known bedpan devices, such as a portable bedpan carrier described in U.S. Pat. No. 3,666,131 issued on May 30, 1972 is incapable of containing the bedpan and waste material after use, and is therefore prone to developing objectionable odors and is generally unsanitary. Other known devices, such as a bedpan device disclosed in U.S. Pat. No. 2,632,185 is integrally formed as part of a hospital bed and is relatively complex requiring mechanical linkages which may significantly increase the cost of such a bed. Due to the deficiencies associated with existing bed-structure invalid toilets, most hospitals use the above-described bedpan which must be manually changed by an attendant.

Accordingly, it is an object of the present invention to substantially overcome the above-described problems.

It is another object of the present invention to provide an improved bedside commode apparatus.

It is also an object of the present invention to provide an automatically actuable bedside commode apparatus.

It is still an object of the present invention to provide a bedside commode apparatus compatible with standard hospital beds of differing heights.

It is yet another object of the present invention to provide a bedside commode apparatus that encloses the soiled bedpan after use to reduce objectionable odors and to assist in maintaining a sanitary environment.

It is yet a further object of the present invention to provide a bedside commode apparatus that folds into a compact configuration when not in use to conserve space.

SUMMARY OF THE INVENTION

The disadvantages of known bedpan devices are substantially overcome with the present invention by providing an improved bedside commode apparatus. The present invention provides a simple and relatively inexpensive mechanized structure that delivers a bedpan to a patient and removes the bedpan after use, where delivery and removal of the bedpan is mechanized and under patient control. When the soiled bedpan is removed, it is enclosed within a sealed box structure to maintain a relatively sanitary environment and eliminate objectionable odors. A door within a base portion allows the bedpan to exit and enter the base portion before and after delivery and subsequent use, respectively, where it may remain until removed and sanitized by an attendant.

The apparatus is extremely portable and rolls on a plurality of wheels or castors which may be fixedly locked when the apparatus is positioned alongside the patient bed. Since operation of the apparatus is under patient control, it may be operatively placed in position many hours prior to use and may be removed many hours after use without causing patient discomfort or objection.

More specifically, the improved bedside commode apparatus of the present invention is removably attachable to a bed of a patient and includes a base portion and a framework structure having at least one vertical support member fixedly attached to the base portion and extending upwardly therefrom. The framework structure includes at least one extension arm attached to an upper portion of the vertical support member and extends horizontally outward toward the bed, where the extension arm assembly is configured to extend over a top surface of the bed.

Also included is a bedpan to receive human waste and a bedpan support platform to releasably secure the bedpan, where the bedpan support platform is movably attached to the framework structure and is configured to move along the vertical support member from a non-use position disposed toward the base portion, to a patient-use position disposed toward an end portion of the extension arm assembly. A drive means is selectively energized by the patient to reciprocally displace the bedpan support platform and the bedpan along the vertical support member and along the extension arm assembly between the non-use position and the patient-use position.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Figure 1:
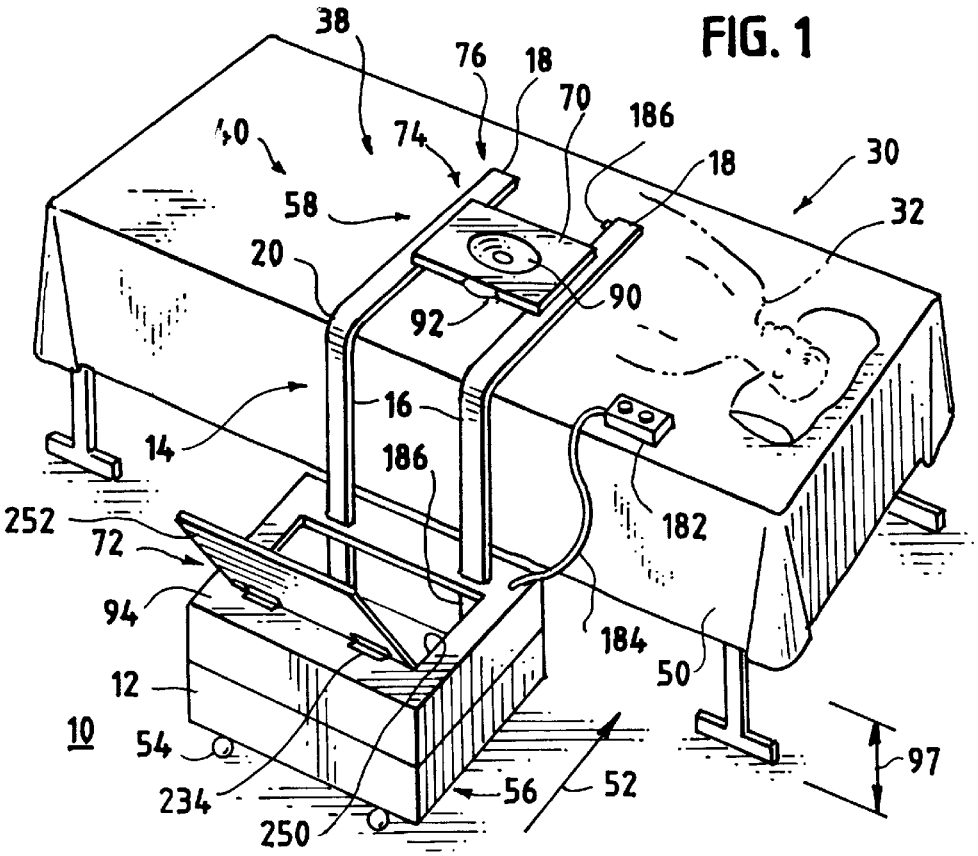
FIG. 1 is a perspective view of a specific embodiment of an improved bedside commode apparatus according to the present invention shown in an operative position prior to use.
Figure 2:
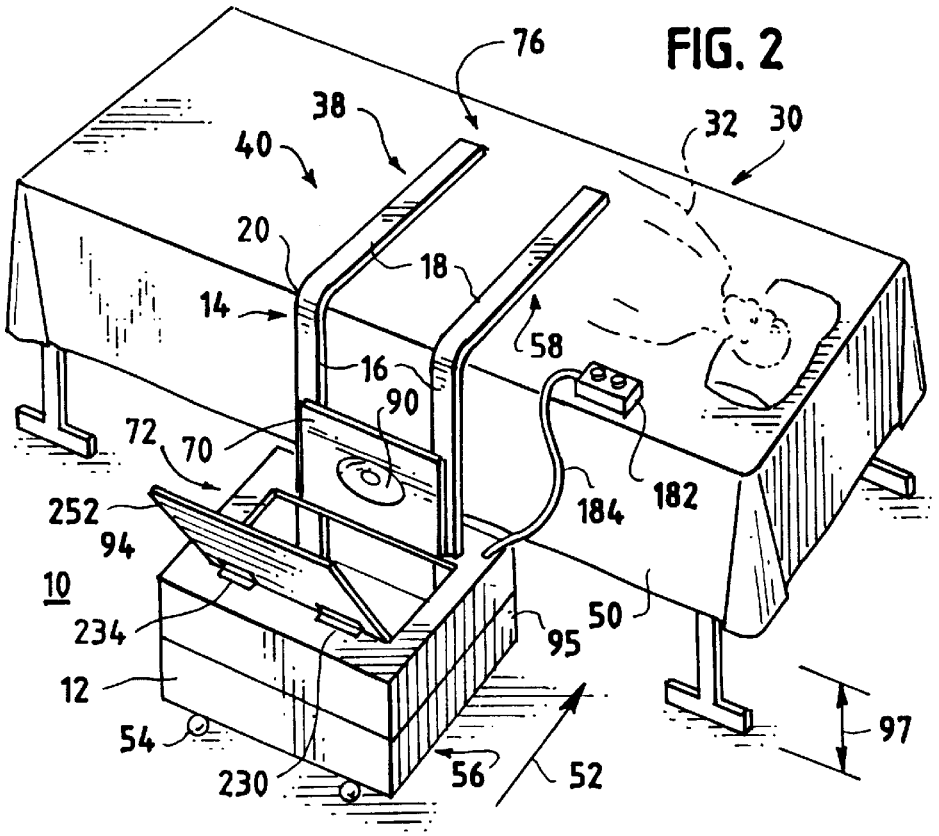
FIG. 2 is a perspective view of a specific embodiment of an improved bedside commode apparatus according to the present invention shown after use.

Referring now to FIGS. 1–2, a bedside commode apparatus 10 is shown generally. The apparatus 10 includes a base portion 12 and a framework structure 14 which includes at least one vertical support member 16 fixedly attached to the base portion and extending upwardly therefrom. The framework structure 14 also includes at least one extension arm 18 attached to an upper portion 20 of the vertical support member 16 and extends horizontally outwardly at about a ninety degree angle. Preferably, two parallel vertical support members 16 are affixed to the base portion 12 and each include extension arms 18 extending horizontally from the upper portion 20 of the vertical support member.

However, any suitable number of support members 16 and an equal number of extension arms 18 may be used depending upon the load bearing capability of the material from which the members are constructed. Preferably, the vertical support members 16 and the extension arms 18 are constructed from rectangular hollow metal tubing, such as aluminum, rigid plastic, or steel tubing. However, any suitably shaped tubing may be used, such as round tubing.

The extension arms 18 are configured to engage a top surface 40 of the bed 30 when the apparatus 10 is operatively positioned alongside the bed. When the apparatus 10 is placed alongside the bed 30, the vertical support members 16 remain essentially parallel to a sidewall 50 of the bed 30 and serve to elevate the extension arms 18 just above or level with the top surface 40 of the bed. Further lateral movement of the apparatus 10 toward the bed 30, in the direction shown by arrow 52, causes the extension arms 18 to engage the top surface 40 of the bed 30, preferably causing slight downward depression of the fabric of the bed.

The apparatus 10 is removably attachable to the bed 30 and includes a plurality of rollers or wheels 54 attached to an external bottom surface 56 of the base portion 12, as is known in the art. This allows the apparatus 10 to be removeably positioned relative to the bed 30 allowing the extension arms 18 to operatively extend toward a central portion 58 of the bed. The wheels 54 are selectively lockable to prevent displacement of the apparatus 10 once operatively positioned alongside the bed 30.

A bedpan support platform 70 is movably attached to the framework structure 14 and is configured to be sequentially displaced vertically and horizontally along the framework structure. The bedpan support platform 70 may be displaced from a non-use position 72 disposed toward the base portion 12, and more clearly shown in FIG. 2, to a patient-use position 74 disposed toward an end portion 76 of the extension arms 18, more clearly shown in FIG. 1.

A bedpan 90 for receiving human waste is releasably secured to the bedpan support platform 70 and is displaced along with the bedpan support platform as the platform is positioned between the non-use position 72 and the patient-use position 74. The bedpan support platform 70 is preferably constructed from stainless steel and is generally rectangular in shape. However, the bedpan support platform 70 may be constructed from any suitable material, such as metal or plastic capable of withstanding sterilization procedures while possessing adequate structural properties.

The bedpan 90 may be secured to the bedpan support platform 70 by clips, straps, magnets and the like and may be removed from the support platform by the patient 32 while in the operative patient-use position 74. Alternatively, the patient 32 may choose to leave the bedpan 90 firmly secured to the bedpan support platform 70 during use.

Additionally, the bedpan 90 may be recessed into a cut-out portion 92 of the bedpan support platform 70 where the contour of the cut-out portion is similar to the shape of the bedpan 90. This assists in securing the bedpan 90 to the bedpan support platform 70 and allows the bedpan to be recessed to a greater degree relative to the bedpan support platform.

In the preferred embodiment, the vertical support member 16 is a single unitary section of tubing that may be displaced relative to the base portion 12 to which it is secured to accommodate patient beds 30 of varying heights. Preferably, the vertical support members 16 extend through a top surface 94 of the base portion 12 and extend within the enclosure defined by the base portion. This allows the vertical support members 16 to be secured to the base portion 12 by at least two points of contact, one point being where they pass through the top surface 94, and the other being where they meet the bottom surface 56. However, the vertical support members 16 may be fastened to the base portion 12 by any suitable means of attachment, such as attachment to an endwall 95 of the base portion. For example, if the vertical support members 16 are secured to the endwall 95 or to the bottom surface 56 of the base 12 by brackets 96 or the like, the support members may be reciprocally displaced relative to the brackets by an amount slightly less than the height of the base portion, as shown by arrow 97.

Figure 3:
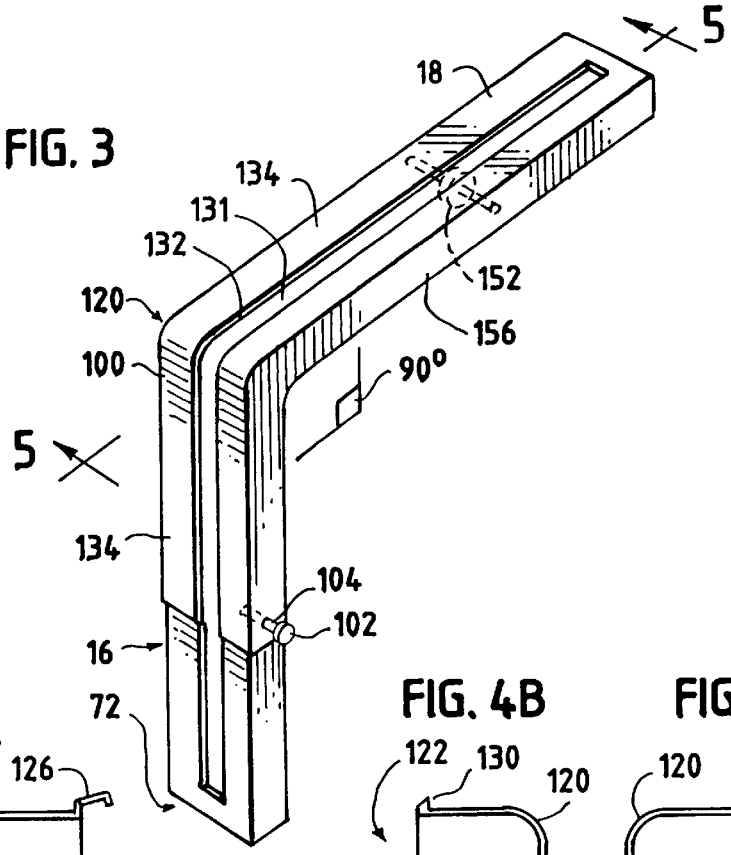
FIG. 3 is an enlarged perspective view of a specific embodiment of a vertical support member and an extension arm shown in FIG. 1.

Referring now to FIGS. 1–3, FIG. 3 illustrates an alternate embodiment where the vertical support members 16 include a telescopic feature to account for the height of different hospital beds 30 having a very large vertical variation. To facilitate rapid and convenient height adjustment, a second vertical member 100 is configured to telescopically extend relative to the vertical support member 16 to permit operative vertical positioning of the bedpan support platform 70 on a plurality of patient beds 30 of differing height.

The vertical support member 16 and the second vertical member 100 are appropriately dimensioned such that a bed 30 of maximum height may be accommodated by upwardly extending the second vertical member relative to the vertical support member. This places the extension arms 18 at a greater height for use with a wide variety of bed 30 heights. A locking mechanism, such as a spring-loaded stud 102, may be used to secure the second vertical member 100 to the vertical support member 16, as is well known in the art. The spring-loaded stud 102 passes through apertures 104 in the walls of both the vertical support member 16 and the second vertical member 100 to prevent movement therebetween. The spring-loaded stud 102 is retractable to allow the two members 16 and 100 to essentially extend telescopically relative to each other.

Figure 4A:
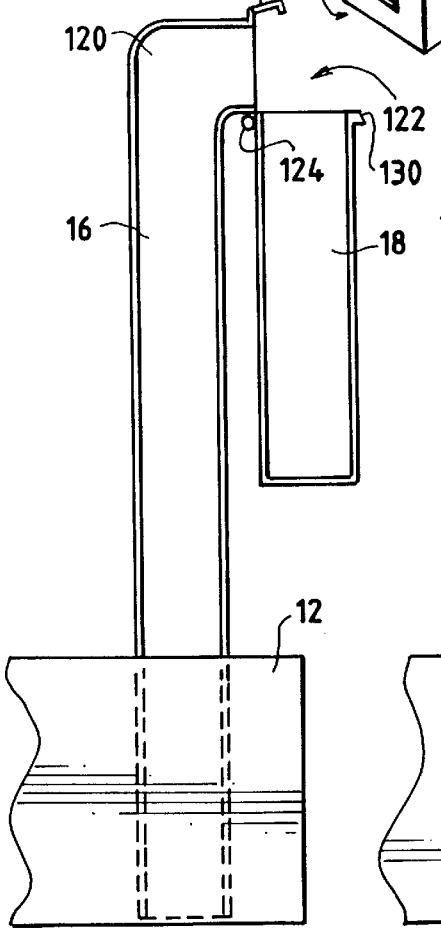
FIGS. 4A–4C are side views of a specific embodiment of an improved bedside commode apparatus according to the present invention particularly showing an extension arm.
Figure 4B:
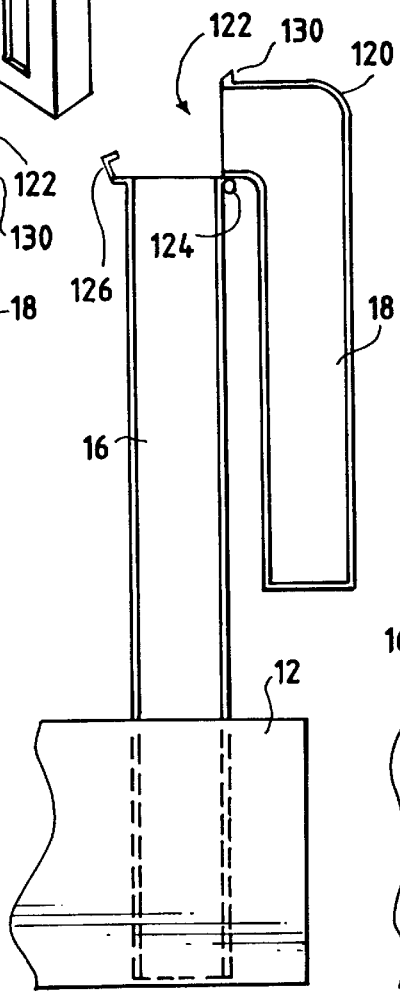

Referring now to FIGS. 1 and 4A–4C, the extension arms 18 are preferably foldable relative to the vertical support members 16. This allows the extension arms 18 to be placed in a parallel orientation relative to the vertical support members 16 when the apparatus 10 is stored during periods of non-use. To facilitate a smooth physical transition between the extension arms 18 and the vertical support members 16, a curved or bent portion 120 may be included as either part of the vertical support member, as shown in FIG. 4A, or as part of the extension arm, as shown in FIG. 4B.

A clamping means 122, such as a hinge 124 and hook 126 arrangement, permits the extension arms 18 to be essentially "broken" from the vertical support members 16 and folded in place parallel to the support members to form a compact structure for storage purposes. The hinge 124 permits the extension arm 18 to pivot relative to the vertical support member 18 when in the "broken" position.

Figure 4C:
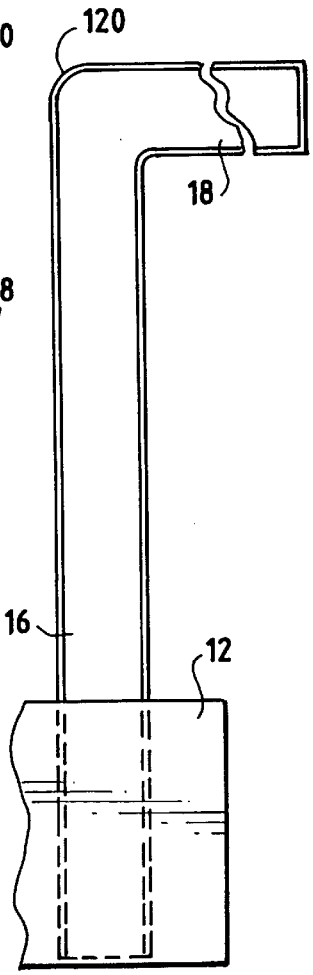

To place the extension arms 18 in an operative position, the extension arms are upwardly pivoted about hinge 124 until they meet the vertical support members 16 at about a ninety degree angle. To lock the extension arms 18 in position, a lip 130 disposed on a peripheral edge of the extension arm adjacent the intersection with the vertical support member 16 is engaged by the hook 126 to rigidly lock it in place. Alternatively, the extension arm 18 may be integrally formed from the vertical support member 16 such that no folding is possible, as illustrated in FIG. 4C.

Figure 5:
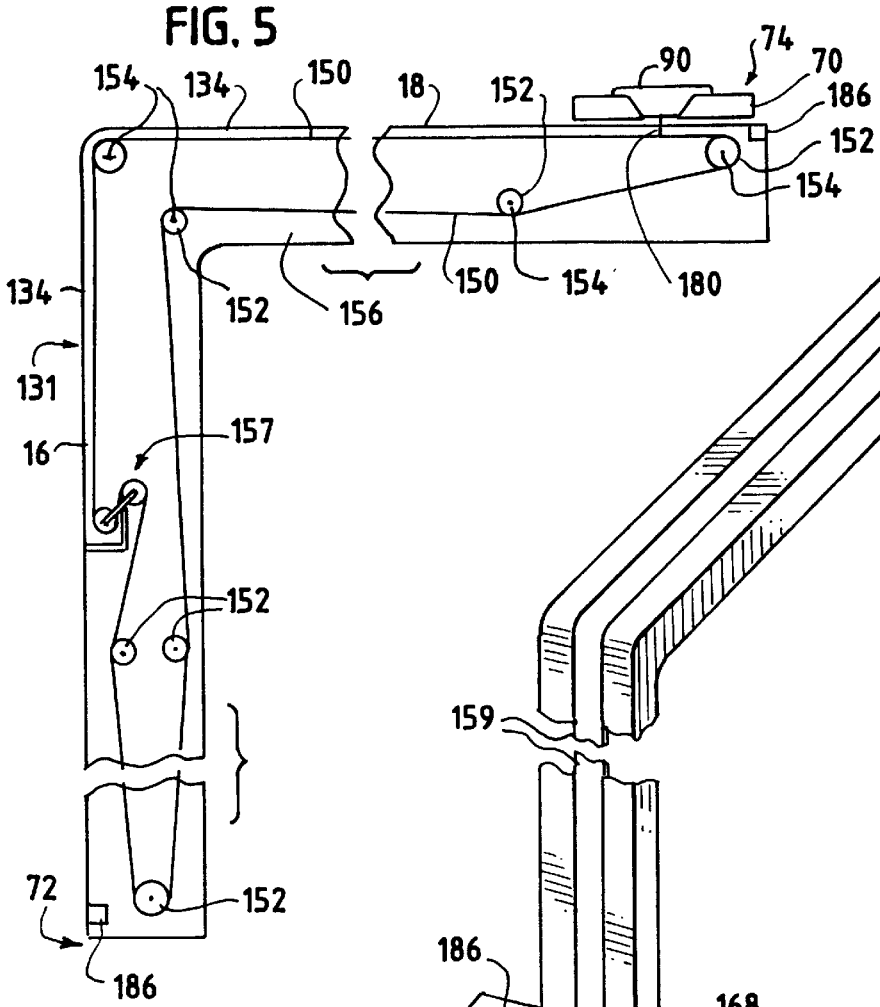
FIG. 5 is a side view of a specific embodiment of a vertical support member and an extension arm shown in FIG. 3 taken along the line 5—5 and in the direction generally shown.
Figure 6:
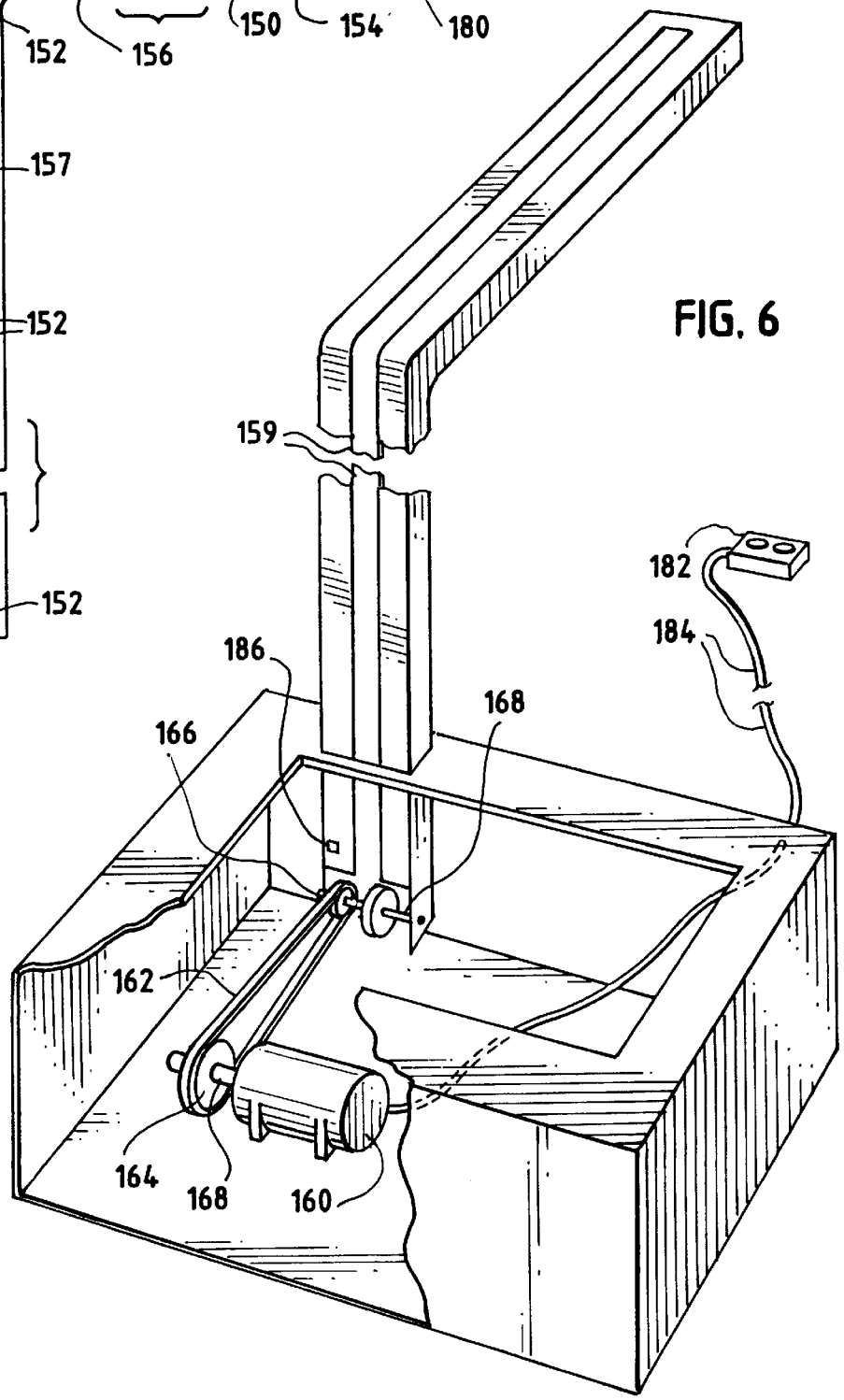
FIG. 6 is an enlarged perspective view partially cut-away showing a motor and bedpan support platform transport means according to the present invention.

Referring now to FIGS. 1, 3 and 5, FIGS. 3 and 5 illustrate a slot 131 formed along the length of the support members 16 and the extension arms 18 to form a linear track 132 disposed along the length of the vertical support member 16 and the extension arm 18. The linear track 132 is narrow relative to the width and skin thickness of the vertical support member 16 and the extension arm 18, and does not compromise the structural integrity of either structural member. The linear track 132 extends along a top outside surface 134 of both the vertical support member 16 and extension arm 18 to provide a linear track along the entire length of both members.

The linear track 132 facilitates displacement of the bedpan support platform 70 and the bedpan 90 vertically along the vertical support member 16 and horizontally along the extension arm 18. A means for displacing or transporting the support platform 70 and the bedpan 90 are incorporated within the vertical support member 16 and the extension arm 18 and may be, for example, a continuous transport belt 150, a chain, a cable and the like. The transport belt 150 is supported within the hollow structural members 16 and 18 by a plurality of rollers or wheels 152 supported by a transverse shaft 154 secured to sidewalls 156 of the structural members 16 and 18.

If the vertical support member 16 is constructed from two sections that telescopically expand relative to each other, as shown in FIGS. 3 and 5, then the transport belt 150 is constructed from material that can stretch to increase and decrease in length to accommodate the change in length of the structural members 16 and 18. As best seen in FIG. 5, a spring driven tensioner mechanism 157 automatically accounts for the change in length of the transport belt 150, as is well known in the art. If the vertical support member 16 is constructed from a single section of material, as shown in FIG. 4C, then the transport belt 150 may be constructed from material such as hard rubber, cable, or chain, that does not stretch.

Referring now to FIGS. 1, 3, and 5–6, FIG. 6 illustrates a forward-reverse motor 160 to drive the transport belt 150. The motor 160 is indirectly coupled to the transport belt 150 by a drive belt 162 fixedly suspended between a drive wheel 164 and a slave wheel 166 mounted in the vertical support member 16. Both the drive wheel 164 and the slave wheel 166 are mounted on transverse shafts 168.

When the motor 160 is energized, the drive wheel 164 rotates causing the drive belt 162 to rotate the slave wheel 166. Rotation of the slave wheel 166, in turn, causes the transport belt 150 to travel along the length of the vertical support member 16 and the support arm 18. The motor 160 may rotate in a clockwise direction or in a counter-clockwise direction so that the transport belt 150 may be reciprocally displaced along the vertical support member 16 and the extension arm 18. Note that the transport belt 150 need only be placed in one of the two vertical support members 16 and extension arms 18, but may be incorporated into both if desired, by using additional wheels and belts.

The bedpan support platform 70 is mounted to the top surface 134 of the vertical support members 16 and the extension arms 18 and is operatively coupled to the transport belt 150 by one or more connectors or links 180 extending through the slot 131 forming the linear track 132. The connector 180 may be pliable or may be a rigid link, as is well known in the art, and is preferably an openable and closeable clasp that allows the platform 70 to be removed and attached to the belt 150 for maintenance purposes.

When the motor 160 is selectively energized; the bedpan support platform 70 and the bedpan 90 are reciprocally displaced along the vertical support members 16 and along the extension arms 18 between the non-use position 72 disposed toward the base portion 12, and the patient-use position 74 disposed toward the far end of the extension arms 18.

The motor 160 is selectively energized by the patient 32 via a control module 182 (FIG. 6) coupled to the motor through an electrical cable 184. The control module 182 controls the direction of rotation of the motor 160 in addition to the selective energization of the motor, as is well known in the art. Over-travel switches 186 disposed within the vertical support members 16 near the non-use position 72 and within the extension arm 18 near the patient-use position 74 sense when the bedpan support platform 70 is in its farthest travel position. The motor 160 is de-energized if the patient attempts to displace the bedpan support platform 70 past its farthest operative positions.

Referring now to FIGS. 1–3 and 7, when the bedpan support platform 70 and the bedpan 90 are reciprocally displaced from the patient-use position 74 disposed toward the end of the extension arm 18, to the non-use position 72 disposed toward the base portion 12, the bedpan support platform must negotiate the curved or bent portion 120 connecting the vertical support member 16 and the extension arm.

Figure 7:
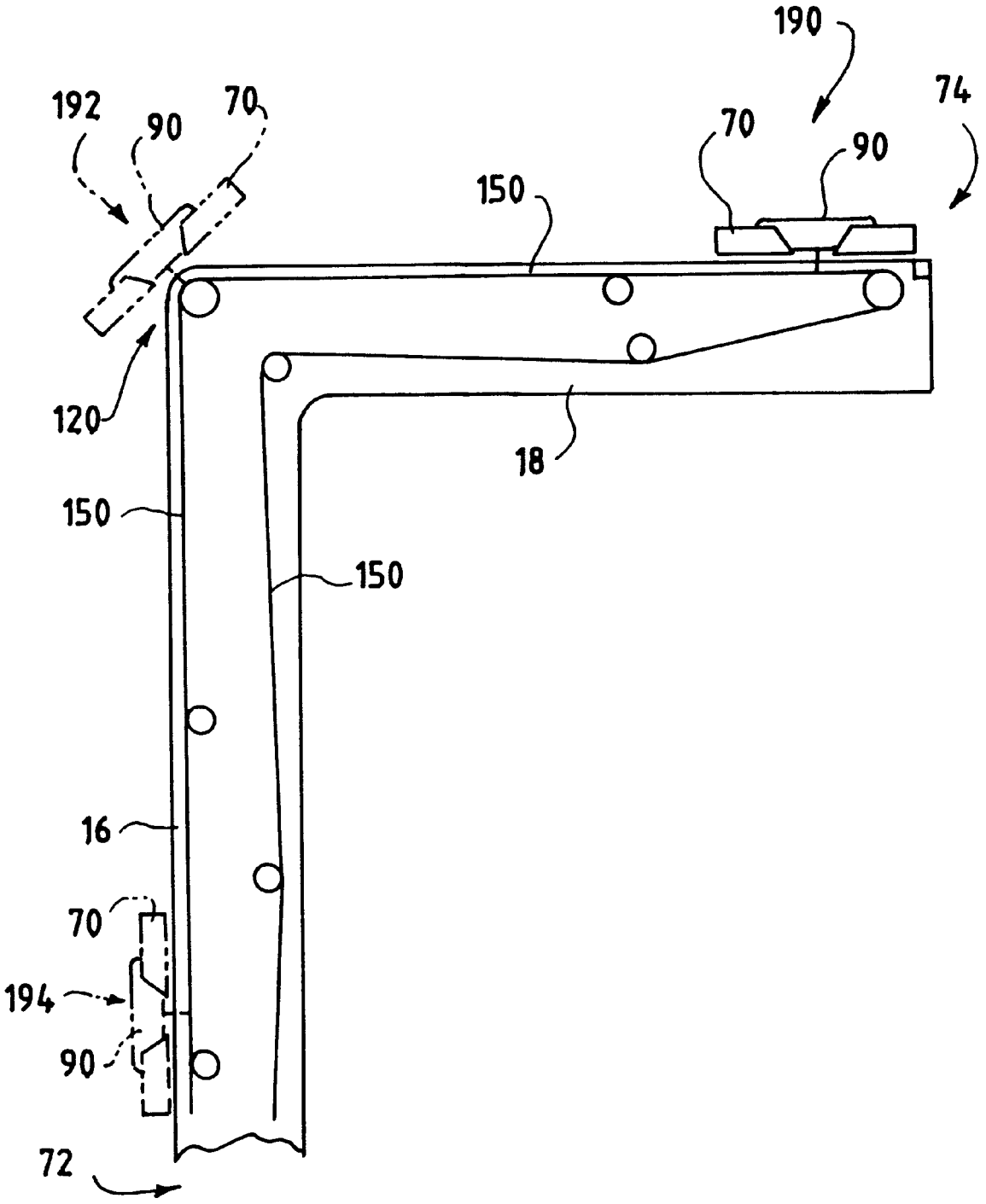
FIG. 7 is a side view of a specific embodiment of a vertical support member and an extension arm showing displacement of a bedpan support platform through an angle of ninety degrees.

During horizontal displacement along the extension arm 18, the bedpan support platform 70 and the bedpan 90 remain in a substantially horizontal orientation, as shown at arrow 190 in FIG. 7. As the bedpan support platform 70 negotiates the curved portion 120, it begins to rotate or pivot, as shown by arrow 192 in FIG. 7. After the bedpan support platform 70 and the bedpan 90 have rotated by about ninety degrees, they are essentially oriented parallel to the vertical support members 16 and remain in the vertical position when displaced vertically along the vertical support members 16, as shown at 194 in FIG. 7. The bedpan 90 is configured with sufficient width to retain all waste in either the horizontal position 190 or the vertical position 194 so that no spillage occurs during horizontal or vertical displacement or during rotation through ninety degrees.

Referring now to FIGS. 1, 7 and 8A–8B, FIGS. 8A–8B illustrate the bedpan 90. The bedpan 90 is generally elongated about a central axis 210 and includes a central aperture 212, an upper surface 214 radially extending away from the central aperture, a sidewall 216 depending from the upper surface, and a bottom surface 218 integrally formed with the sidewall. The upper surface 214 is substantially parallel to the bottom surface 218 and extendingly overlaps a portion of the bottom surface, as shown by arrow 220 in FIG. 8A.

Figure 8A:
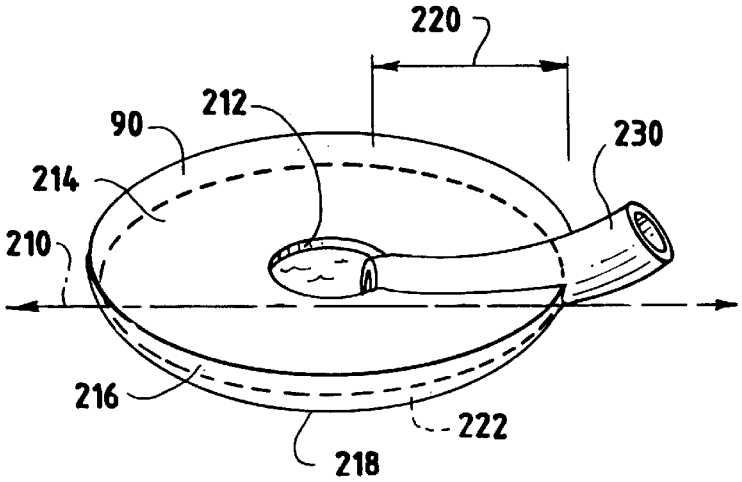
FIGS. 8A–8B are perspective views of a specific embodiment of an improved bedpan.
Figure 8B:
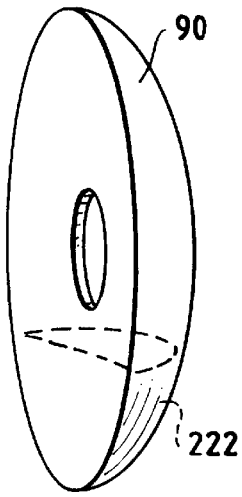

This large overlap 220 allows the bedpan 90 to be rotated by about an angle of approximately ninety degrees while containing all waste 222 therein. FIG. 8B illustrates the bedpan 90 in a vertical orientation and particularly shows that the waste 222 is not spilled when the bedpan is rotated from the horizontal position 190 to the vertical position 194, as shown in FIG. 7. Additionally, a funnel device 230 may be clipped to the bedpan 90 to aid male urination.

Figure 9:
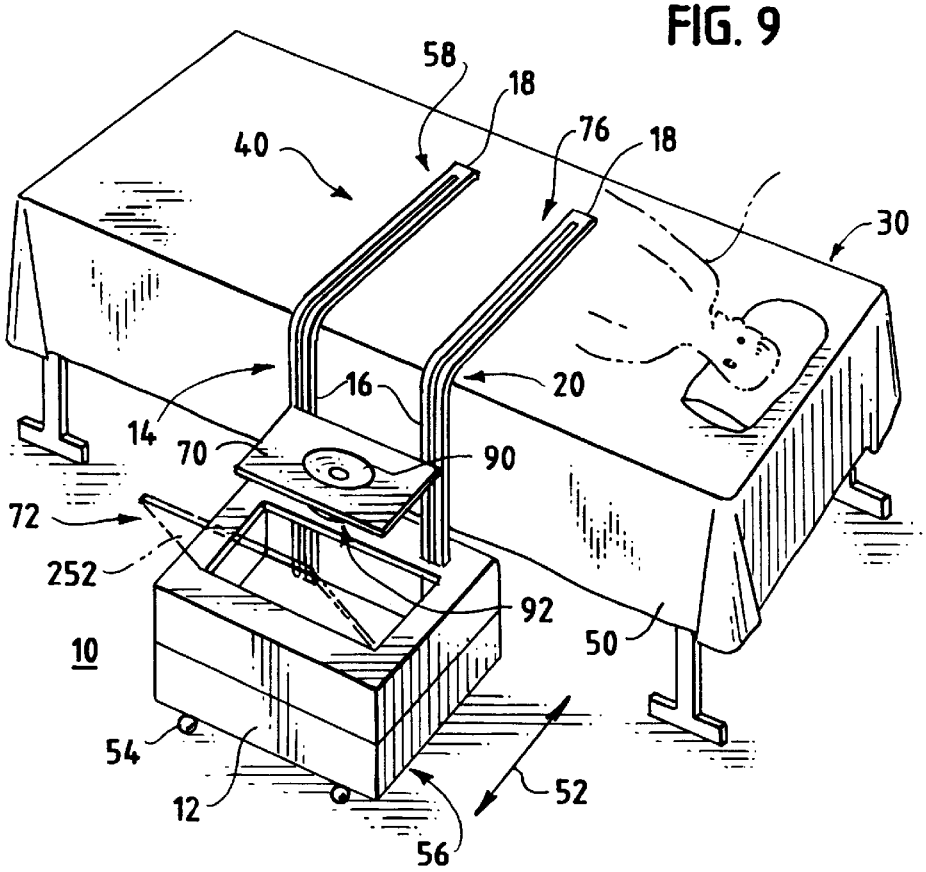
FIG. 9 is a perspective view of an alternate embodiment of a bedpan support platform.

Referring now to FIGS. 1 and 9, FIG. 9 illustrates an alternate embodiment where the bedpan support platform 70 and the bedpan 90 always remain in a horizontal orientation during reciprocal displacement. The bedpan support platform 70 and the bedpan 90 remain in a substantially horizontal orientation when displaced horizontally along the extension arms 18 and also remain in a substantially horizontal orientation when displaced vertically along the vertical support members 16. Suitable linkage, known in the art, can be utilized for this purpose.

Referring now to FIGS. 1 and 2, the base portion 12 includes an aperture 250 through which the bedpan support platform 70 and the bedpan 90 pass in the non-use position 72. A door 252 is sealingly attached to the base portion 12 by hinges 254 or other suitable means and sealingly covers the aperture after the bedpan support platform 70 and the bedpan 90 have been received within the base portion. The door 252 provides a closure so that the base portion 12 is essentially a sealed structure such that objectionable odors are contained within the base portion after patient use.

The door 252 is automatically opened and closed when the bedpan support platform 70 passes through the aperture 250. The door 252 is connected to the transport belt by a linkage means or alternatively, a separate motor may be used to control operation of the door, as is known in the art. Alternatively, the base portion 12 may be a closed shell having no aperture. In this case, the bedpan support platform 70 and bedpan 70 remain in the non-use position 72 disposed above or resting on the base portion 12 after patient use.

The drive for the belt may be selected from the group consisting of an electric motor, a pneumatic motor, a hand-powered crank and a compressed gas driven motor.

A specific embodiment of an improved bedside commode apparatus according to the present invention has been described for the purpose of illustrating the manner in which the invention may be made and used. It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

What is claimed is:

1. A bedside commode apparatus which is removably attachable to a bed of a patient, the apparatus comprising:

a base portion;

a framework structure including at least one vertical support member fixedly attached to the base portion and extending upwardly therefrom;

said framework structure including at least one extension arm attached to an upper portion of the at least one vertical support member and extending horizontally outward toward the bed, said at least one extension arm configured to extend over a top surface of the bed;

a bedpan to receive human waste;

a bedpan support platform to releasably secure the bedpan thereto, said bedpan support platform movably attached to the framework structure and configured to move along the at least one vertical support member from a non-use position disposed toward the base portion to a patient-use position disposed toward an end portion of the at least one extension arm; and drive means selectively energized by the patient to reciprocally displace the bedpan support platform and the bedpan along the at least one vertical support member and along the at least one extension arm between the non-use position and the patient-use position.

2. The apparatus according to claim 1 wherein the base portion includes a plurality of rollers to allow the apparatus to be removeably positioned relative to the bed of the patient such that the at least one extension arm operatively extends toward a central portion of the bed.

3. The apparatus according to claim 2 wherein the rollers are selectively lockable to prevent displacement of the apparatus once operatively positioned along the bed.

4. The apparatus according to claim 1 wherein the base portion is configured to define an aperture disposed on an upper planar surface and includes a door for sealingly covering the aperture, said aperture for receiving the bedpan support platform and the bedpan when in the non-use position such that the bedpan support platform and the bedpan are sealingly enclosed within the base portion.

5. The apparatus according to claim 1 wherein the at least one vertical support member includes a second vertical member configured to telescopically extend relative to the at least one vertical support member to permit operative vertical positioning of the bedpan support platform over a plurality of patient beds of differing height.

6. The apparatus according to claim 1 wherein the framework structure includes clamping means to secure the at least one extension arm to the at least one vertical support member at a predetermined height along the vertical support member.

7. The apparatus according to claim 6 wherein the clamping means includes hinge means to couple the extension arm to the vertical support member, a lip attached to the extension arm, and a hook attached to the vertical support member, said hook configured to engage the lip to fixedly secure the extension arm at about a ninety degree angle relative to the vertical support member.

8. The apparatus according to claim 7 wherein the clamping means allows the at least one extension arm to be placed in a parallel orientation relative to the at least one vertical support member when the lip is disengaged from the hook.

9. The apparatus according to claim 1 wherein the at least one extension arm is integrally formed with at least one vertical support member.

10. The apparatus according to claim 1 wherein the framework structure includes a plurality of vertical support members fixedly attached to the base portion, and a plurality of extension arms, each extension arm attached to a vertical support member, said vertical support members being parallel to each other and substantially perpendicular to the extension arms.

11. The apparatus according to claim 1 wherein the bedpan support platform and the bedpan remain in a substantially horizontal orientation when displaced vertically along the at least one vertical support member and remain in a substantially horizontal orientation when displaced horizontally along the at least one extension arm.

12. The apparatus according to claim 1 wherein the bedpan support platform and the bedpan remain in a substantially horizontal orientation when displaced horizontally along the at least one extension arm and are rotated by about ninety degrees and remain in a substantially vertical orientation when displaced vertically along the at least one vertical support member.

13. The apparatus according to claim 1 wherein the at least one vertical support member and the at least one extension arm include a linear track disposed along a length thereof to facilitate reciprocal displacement of the bedpan support platform and the bedpan vertically and horizontally along the at least one vertical support member and the at least one extension arm, respectively.

14. The apparatus according to claim 13 wherein the bedpan support platform is operatively coupled to a transport means disposed in said vertical support members and said extension arms to facilitate reciprocal displacement of the bedpan support platform and the bedpan along the linear track.

15. The apparatus according to claim 14 wherein the transport means is operatively coupled to the drive means such that the transport means displaces the bedpan support platform and the bedpan along the linear track when the drive means is energized.

16. The apparatus according to claim 14 wherein the transport means is selected from the group consisting of a belt, a cable and a chain.

17. The apparatus according to claim 16 wherein the at least one vertical support member is configured to reciprocally increase and decrease in height relative to the base portion to permit operative vertical positioning of the bedpan support platform relative to a plurality of patient beds of differing height such that said increase and decrease in height causes the transport means to correspondingly increase or decrease in length.

18. The apparatus according to claim 17 wherein the transport means is configured to increase and decrease in length when the at least one vertical support member is increased and decreased, respectively, in length.

19. The apparatus according to claim 1 wherein the bedpan is generally elongated about a central axis and includes a central aperture, an upper surface radially extending away from the central aperture, a sidewall depending from the upper surface, and a bottom surface integrally formed with the sidewall, said upper surface substantially parallel to the bottom surface and extendingly overlapping a portion of the bottom surface such that when the bedpan is rotated by about ninety degrees from a substantially horizontal orientation, the waste is contained therein and does not exit the aperture.

* * * * *